US012054937B2

(12) United States Patent
Baum

(10) Patent No.: US 12,054,937 B2
(45) Date of Patent: Aug. 6, 2024

(54) PORTABLE SEGMENTABLE/EXPANDABLE MODULE STRUCTURES

(71) Applicant: Asher Baum, Brooklyn, NY (US)

(72) Inventor: Asher Baum, Brooklyn, NY (US)

( * ) Notice: Subject to any disclaimer, the term of this patent is extended or adjusted under 35 U.S.C. 154(b) by 0 days.

(21) Appl. No.: 17/868,652

(22) Filed: Jul. 19, 2022

(65) Prior Publication Data

US 2023/0015363 A1 Jan. 19, 2023

Related U.S. Application Data

(60) Provisional application No. 63/223,403, filed on Jul. 19, 2021.

(51) Int. Cl.
*E04B 1/348* (2006.01)
*E04B 1/343* (2006.01)

(52) U.S. Cl.
CPC ..... *E04B 1/34861* (2013.01); *E04B 1/34384* (2013.01)

(58) Field of Classification Search
CPC .... E04B 1/34861; E04B 1/34384; E04B 7/16; E04B 2001/5881; E04B 2001/5887; E04B 1/34326; E04B 1/5831; E06B 9/54
See application file for complete search history.

(56) References Cited

U.S. PATENT DOCUMENTS 4,676,039 A * 6/1987 Leiter ..... E04B 1/34315 52/270
4,677,797 A * 7/1987 Roth ..... E04H 3/10 52/282.3
5,564,234 A * 10/1996 Vermeulen ..... A01G 9/227 52/63
5,884,647 A * 3/1999 Dwek ..... E04H 15/52 135/147
6,024,153 A * 2/2000 Goldman ..... E04B 7/166 160/84.01
7,971,622 B2 * 7/2011 Trionfetti ..... E04H 1/1272 160/122
8,528,623 B2 * 9/2013 Roberts ..... E06B 9/54 160/267.1

(Continued)

OTHER PUBLICATIONS

Search Report and Written Opinion for PCT/US2022/037643 (8 pages). (Year: 2022).*

*Primary Examiner* — Rodney Mintz
(74) *Attorney, Agent, or Firm* — Israel Nissenbaum; Yitay Nissenbaum

(57) ABSTRACT

A modular enclosure structure having at least three walls and comprised of at least three elongated posts selected from at least two elongated upright/vertical posts. Each post has a longitudinal hollow a flexible and durable compacted sheet material therein and wherein a narrow longitudinal through-slot aligned with the free end of each of the compacted sheet materials. Sheet material in each hollow is able to be externally drawn and retracted with manipulation of the free end. The free end of each sheet material has a latching member attached to either an elongated upright/vertical post member, having at least two latching members or to the two elongated posts having hollows and also cooperative latching members, wherein walls of sheet material are externally drawn from the posts with compacted sheet material to form an enclosure comprising at least three walls of sheet material.

15 Claims, 19 Drawing Sheets

(56) References Cited

U.S. PATENT DOCUMENTS

| | | | | |
|---|---|---|---|---|
| 9,121,299 | B2 * | 9/2015 | Giametta | F16J 15/3288 |
| 9,351,599 | B2 * | 5/2016 | Roberts | E06B 9/54 |
| 9,428,955 | B2 * | 8/2016 | Fleischman | E06B 9/42 |
| 10,011,985 | B2 * | 7/2018 | Strong | E04B 2/76 |
| 10,844,657 | B2 * | 11/2020 | Fleischman | E06B 9/174 |
| 10,900,216 | B2 * | 1/2021 | Thøgersen | E04C 3/29 |
| 11,866,936 | B2 * | 1/2024 | Anshin | E04B 7/166 |
| 2002/0092628 | A1 * | 7/2002 | Todd | E06B 9/08 160/309 |
| 2008/0229689 | A1 * | 9/2008 | Trionfetti | E04H 1/1272 160/122 |
| 2010/0301296 | A1 * | 12/2010 | Ratzenberger | E01F 13/028 256/24 |
| 2011/0114272 | A1 * | 5/2011 | Roberts | E06B 9/54 160/293.1 |
| 2013/0312355 | A1 * | 11/2013 | Padeh | E04B 2/00 52/584.1 |
| 2014/0041814 | A1 * | 2/2014 | Roberts | E06B 9/54 160/271 |
| 2014/0262084 | A1 * | 9/2014 | Fleischman | E06B 9/40 160/368.1 |
| 2014/0361489 | A1 * | 12/2014 | Giametta | F01D 11/127 277/355 |
| 2016/0032646 | A1 * | 2/2016 | Fleischman | E06B 9/68 16/96 R |
| 2016/0265275 | A1 * | 9/2016 | Rosell Rosell | E06B 9/78 |
| 2016/0369556 | A1 * | 12/2016 | Fleishman | E06B 9/40 |
| 2017/0159289 | A1 * | 6/2017 | Strong | E04B 2/7437 |
| 2017/0211315 | A1 * | 7/2017 | Fleischman | E06B 9/13 |
| 2019/0360191 | A1 * | 11/2019 | Thøgersen | E04C 3/29 |
| 2022/0403651 | A1 * | 12/2022 | Anshin | E04B 7/166 |
| 2023/0028153 | A1 * | 1/2023 | Lovász | E05D 15/0608 |
| 2024/0093487 | A1 * | 3/2024 | Anshin | E04F 10/10 |

* cited by examiner

1 MODULE CONFIGURATION

2 MODULES CONFIGURATION

3 MODULES CONFIGURATION

4 MODULES CONFIGURATION

PORTABLE SEGMENTABLE/EXPANDABLE MODULE STRUCTURES

This application takes priority from provisional application U.S. Ser. No. 63/223,403 filed Jul. 19, 2021, the disclosure of which is included herein in its entirety by reference thereto.

FIELD OF THE INVENTION

This invention relates to portable, temporary, modular structures and the components thereof, the structures being capable of segmentation and expansion with structural integrity and adaptation for indoor and outdoor use with rapid deployment and component break down for portability and especially relates to structures with integral and selectable roofing components.

BACKGROUND

Currently, modular temporary structures are generally constructed of light-weight solid structural wall materials such as of thin wood or plexiglass, which are collapsed, stored and transported in stacked piles. Alternatively, thin walls are made of completely flexible materials such as canvas or plastic tarpaulins, which are wrapped around and anchored all around its perimeter either in one piece or in segmented sections. These structures are insubstantial, look flimsy and are susceptible to sagging, rippling and other unsightly appearances and structural deficiencies especially in outdoor settings.

In some instances, the flexible materials are contained within their own containers for separate storage. Such structures may be heavy enough to require power tools to assemble or multiple persons to erect. Because the thin light-weight walls, even if solid, are incapable of being structurally self-sustaining, unless they are simple curtains in an indoor setting, they are anchored to some sort of separate structural framework.

Modular temporary structures, as opposed to simple curtained-off areas, are generally utilized for applications such as tradeshow booths; medical/emergency module (FEMA, Red cross, etc.); greenhouses (particularly with transparent or translucent walls); storage sheds; pergolas or gazebos; gathering "tents"; military bivouacs, or temporary religious structures such as sukkah structures.

Typical modular structure components for even single module construction weigh on the order of hundreds of pounds and are often quite bulky and difficult to properly handle.

General requirements or useful features (but not required) for such temporary structures include:

- easily transportable components, especially stackable, with minimal cross section dimensions, and manageable minimal weight;
- being erectable with minimal, common or no tools;
- being structurally strong modules, resistant to normal or even foreseeable conditions, particularly in outdoor applications;
- being aesthetically pleasing in appearance;
- being resistant to drafts and insect incursions;
- being capable of meeting size requirements by expansion/contraction and segmentation into separate cubicle modules or overall open areas;
- being provided with stability conforming elements particularly with respect to uneven supporting terrain;

- being capable of having integrated rooting of different structural design and capability;
- having waterproof and/or water diverting or draining capability and/or snow resistant or removal capability.

SUMMARY

It is an object of the invention to provide a relatively compact and light weight easily transportable and erectable modular structure with integrated wall and supporting frame elements, with capability of areal size contraction/expansion capability as well as compartmentability and segmentation and also with ease in breakdown.

It is a further object of the invention to provide such structure with both aesthetic ornamental appearance and structural integrity, as well as resistance to draft and insect incursion and with provision for integral channeling of utility elements commonly present in permanent structures such as lighting, plumbing, heating and cooling, electrical and data wiring, and the like.

It is yet another object of the invention to provide a structure which is weather resistant and stable, regardless of supporting terrain.

It is another object oft invention to provide a structure which is integrable with a roofing structure.

It is yet another object of the invention to provide for interchangeability of internal and external components for changing aesthetic or utilitarian purposes.

Generally the invention comprises a modular enclosure structure having at least three walls and comprised of at least three elongated posts selected from at least two elongated upright/vertical or cross beam/horizontal post member, with each having at least one longitudinal hollow therein. Each hollow has a flexible and durable compacted sheet material therein and a narrow longitudinal through-slot aligned with the free end of each of the compacted sheet material, whereby the sheet material in each hollow is able to be externally drawn and retracted with manipulation of the free end. The free end of each sheet material further comprises a latching member. As an alternative to one of the posts having a hollow with contained compacted sheet material, the structure may comprise an elongated upright/vertical or cross beam/horizontal post member, comprising at least two latching members which cooperatively latch with the latching member of the free end. These posts may themselves be optionally replaced with latching members included in the hollow containing posts. Walls of sheet material are externally drawn from the posts and latched to form an enclosure comprising at least three walls of sheet material.

In an embodiment, the modular structure and its component members, comprise three or more fabric walls comprised of the following components (with three being a minimum ideal for a closed module structure). Wall materials are also referred to herein as "wall(s)" or "sheet(s)":

a) An elongated upright/vertical or cross beam/horizontal post, with at least one longitudinal hollow therein with each configured to retain a flexible and durable compacted sheet material therein such as in an extendable/retractable coil or an accordion fold configuration with an anchored end and a free end. The post further comprises a narrow longitudinal through-slot aligned with the free end of the compacted sheet material whereby the sheet material is able to be externally drawn and retracted with manipulation of the free end (commonly manually but possibly with automatic controls). In an embodiment, the free end is integrated with a longitudinal rail handle configured to provide for the manipulation and to impart structural rigidity to the free end. In a further embodiment, the post comprises at least one first latching/locking element and the rail handle comprises a second latching/locking element configured to be engaged with the first latching/locking element of the post. In a still further embodiment the second latching/locking elements are configured to be engaged with each other for wall elongation as desired or required. In another embodiment, the post comprises at least two longitudinal hollows therein with retained flexible and durable compacted sheet material contained within each hollow.

b) An elongated upright/vertical or cross beam/horizontal post, comprising at least two first latching/locking elements configured to be respectively engaged with second latching/locking elements of rail handle (i.e., without contained sheet material).

With upright posts, sheet material walls are drawn horizontally and with horizontal posts, the sheet material walls are drawn vertically. Coiled sheet materials are retained on a spool retaining member contained within the post hollows and the spool retaining members extend along the longitudinal axis of the respective posts. In the alternative embodiment of a folded sheet material, the flexible and durable sheet material is configured to be folded within the elongated upright member to a minimal dimension along the longitudinal axis in an accordion-like structure with appropriate folding controls. The coiled or folded sheet material is configured to be respectively uncoiled or unfolded and extended out of and away from the elongated upright post to become a "wall" element of an enclosure of a predetermined length. Breakdown of a modular structure, as desired, such as for transport, is effected by re-coiling, such as with spring elements or pull controls (as with a folding wall material structure) to minimal transport size and with wall sheet material protectively contained within respective posts.

For simplicity and ease in discussion and understanding, the following discussion refers to the upright posts containing the sheet material with horizontal posts providing the connection cross beams in an exemplary manner. It is understood that reverse vertical-horizontal) configurations are within the purview of the invention and are understood as being readily derivable, one from the other.

Additional elements of the modular structure comprise predetermined fixed length or optional length adjustable (such as with telescoping components) cross beam extensions or posts (without contained sheet material). These cross-beam extensions or posts are horizontal with upright sheet material containing posts and vertical with horizontal sheet material containing posts. The cross-beam posts (whether horizontal or vertical) are configured to be fixedly engaged by means of end engagement elements of at least two upright positioned elongated upright posts, most effectively with a snap together engagement between an end of a post and an end of the cross beam post, whereby the elongated upright posts are stabilized in an upright position (and horizontal posts similarly stabilized).

In embodiments, the horizontal cross-beam extension posts are provided for use with upright posts with downwardly extending tracks configured to engage (or closely retain) upper lateral edges of the extended sheet material as guides for the extension of the sheet materials and the stabilization thereof against movement of walls formed by the sheet materials. In embodiments, the tracks are configured to closely engage the lateral edges of the sheet material, without impeding extension or retraction movement of the sheet materials, to provide structural stability and to minimize external incursion of insects, wind drafts, rain (if used outdoors) or other inclement conditions. Brush-like materials adjacent to the tracks (extending longitudinally along the track and extending thereacross) may be utilized to filter out dirt, insect or other undesirable materials from entering the structure.

The upper ends of the elongated upright posts, configured to be upwardly positioned relative to a support surface, are provided with at least two engagement elements configured to be cooperatively engaged with at least two cross beam extension posts. The base ends of the elongated upright posts, as uprightly positioned, are optionally provided with leveling adjusting members whereby the relative positioning of the elongated upright posts is properly structurally compensated relative to the supporting terrain surface, particularly for outdoor use.

To complete the wall structure with respect to stability, additional fixed length or length adjustable extension posts similar to or the same as the upper placed extension posts, may be optionally utilized to connect the bases of the elongated upright posts (with appropriate connection elements), for enhanced structural stability. In addition, such cross beam extension posts may similarly comprise track elements which face upwardly and which are aligned with the upper tracks, with proper connections, for engagement with the lower lateral edges of the extended sheet materials and, in an embodiment, with respective ends of the rail handle. In this embodiment (with rail handle end engagement with one or two tracks) the rail handle provides a fixed track movement and support for the attached end of the sheet material in any extended position and with the edge of the sheet materials being closely enclosed within the track and brush materials. This provides a fully stable wall structure of high integrity while enhancing proper construction and enabling ease in break-down of modular structures made with these components.

Base cross beam extension posts, since they either rest on or close to a substrate or ground surface may provide an impediment to entry into a module and accordingly they may be provided with integral or attachable ramped elements or with the posts themselves having inner and outer side ramping configurations. This configuration adjacent opening or doors facilitates rolling entry of heavy items into and out of respective modules.

It is understood that the functions and structures of the upright posts and the cross-beam posts may be swapped whereby the cross beam posts contain the sheet materials, with the sheet materials being extended vertically (up and down) rather than horizontally across. Positioning of fastening elements and the like are appropriately modified with such swapped positioning and vertically formed walls.

Roofing components, as desired or needed for various applications, may be configured for being fastened to the wall structural elements of elongated upright posts and/or cross beam extension posts for maximum stability. Alternatively, the roofing elements can be simply placed, with resting support on the elongated upright posts and/or cross beam extension posts, for rapidity or as dictated by the use, such as with a sukkah structure. Roofing for non-standard sized modules (such as larger dimension modules) may require customization or skeletal support structures as dictated by the size.

Flooring is generally that of existing substrate surfaces (including mobile surfaces such as of flatbed trucks), though simple roiled mats or even coiled or similar materials within posts (as with the walls and roofing structure) may be used, particularly with outdoor structures.

Though three walled modular structure enclosures are included herein, at least four sided enclosures provide the most efficient space utilization and structures including closed structures, and are hereinafter referred to, with exemplification of structural basics and multiple extensions thereof.

In an embodiment with a 2.5 inch internal cavity diameter, wall segments of typical materials can extend to about 10 feet (defined herein as a standard module component), with longer lengths being possible with multiple wall extending posts such as an arrangement of 30 ft by using 3 segments of 10 ft. Alternatively, 30 feet of wall segments are possible with 6-8 inch internal cavity diameters. Typical weights of all the components of the standard 10 square foot module is on the order of about 150 pounds (depending, of course, on the materials used) and generally about 15 pounds per fabric containing posts. This is in contrast to existing module components which usually weigh in excess of 500 pounds.

In an arrangement with a 2.5 inch core, a common fabric thickness of 0.6 mm will provide an 11 ft length fabric inside the post, with a 0.3 mm thickness providing about 15 feet of wall length. It is understood that changes in material and post dimension will allow for variations in wall length.

Rollable/collapsible roof and wall materials may be comprised of, but are not limited to, collapsible (coilable or foldable) fiberglass, nylon, PVC, Kevlar, canvas, polyester, etc. and may include dirt, antifungal, fire-retardant, weatherproofing and UV resistant protection, etc.

Posts (uprights and horizontal) and connector post materials may be comprised of, but are not limited to, structural plastics such as PVC, metal such as aluminum or steel, wood, composite, etc.; and may include dirt, antifungal, fire-retardant, weatherproofing and UV resistant protection, etc. The particular components used will determine the weight of the module components and the structural strength of the structure which can be varied depending on particular exigencies.

The posts and connector posts may be configured to carry interchangeable decorative cover materials and are configured with channels, magnets, apertures and the like for changeably carrying operational elements useful in the modules such as of a utility nature (lighting, heating, cooling, plumbing, electrical wiring and data connections, etc.).

Ideal materials should be resistant to damage from normal use and should also be light weight for enhanced portability and ease in assembly and break down for transport.

Other objects, features and advantages of the invention will become more evident from the following disclosure and drawings in which:

SHORT DESCRIPTION OF THE DRAWINGS

Figure 12A:
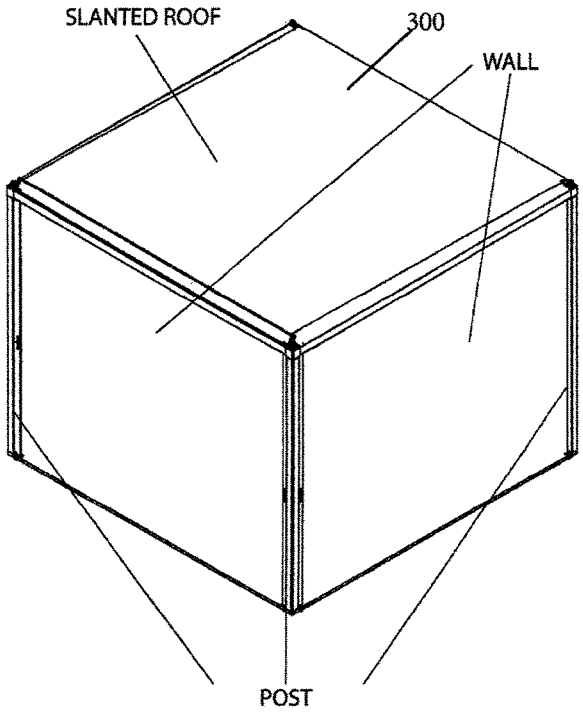
Figure 12B:
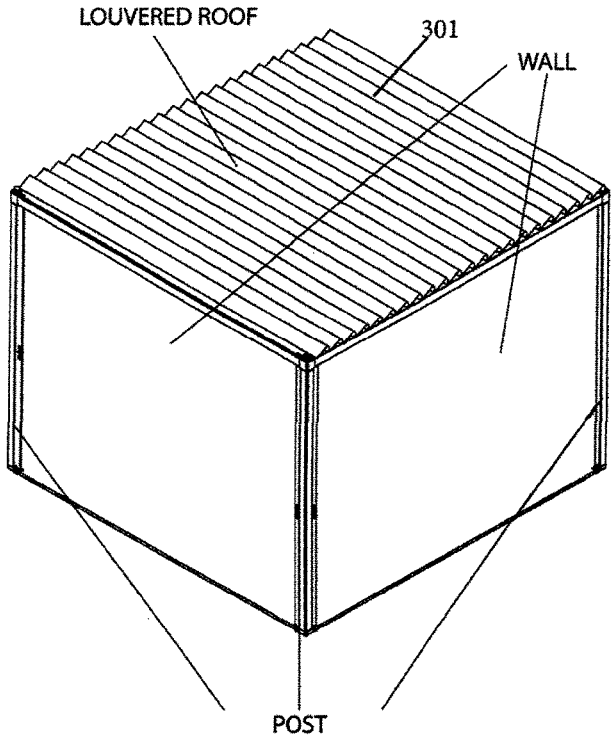
Figure 12C:
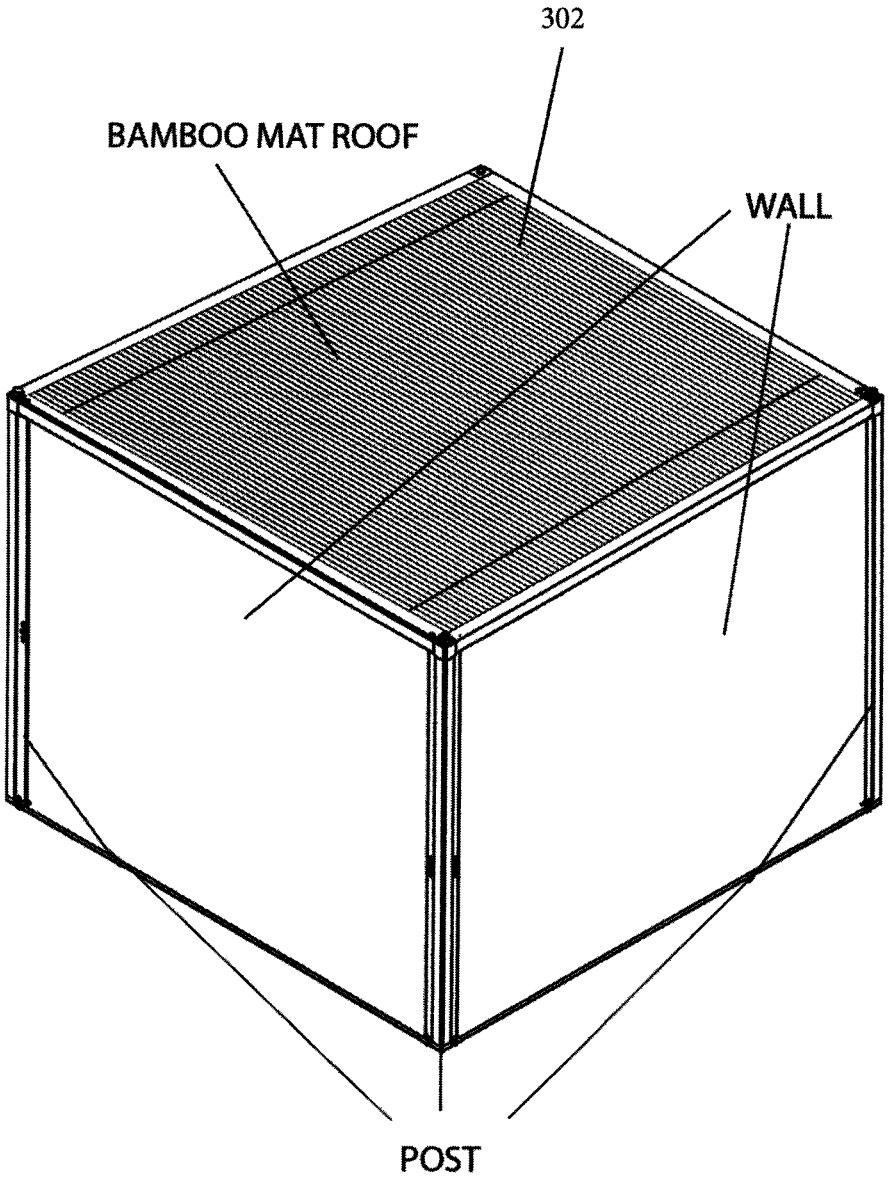
Figure 13:
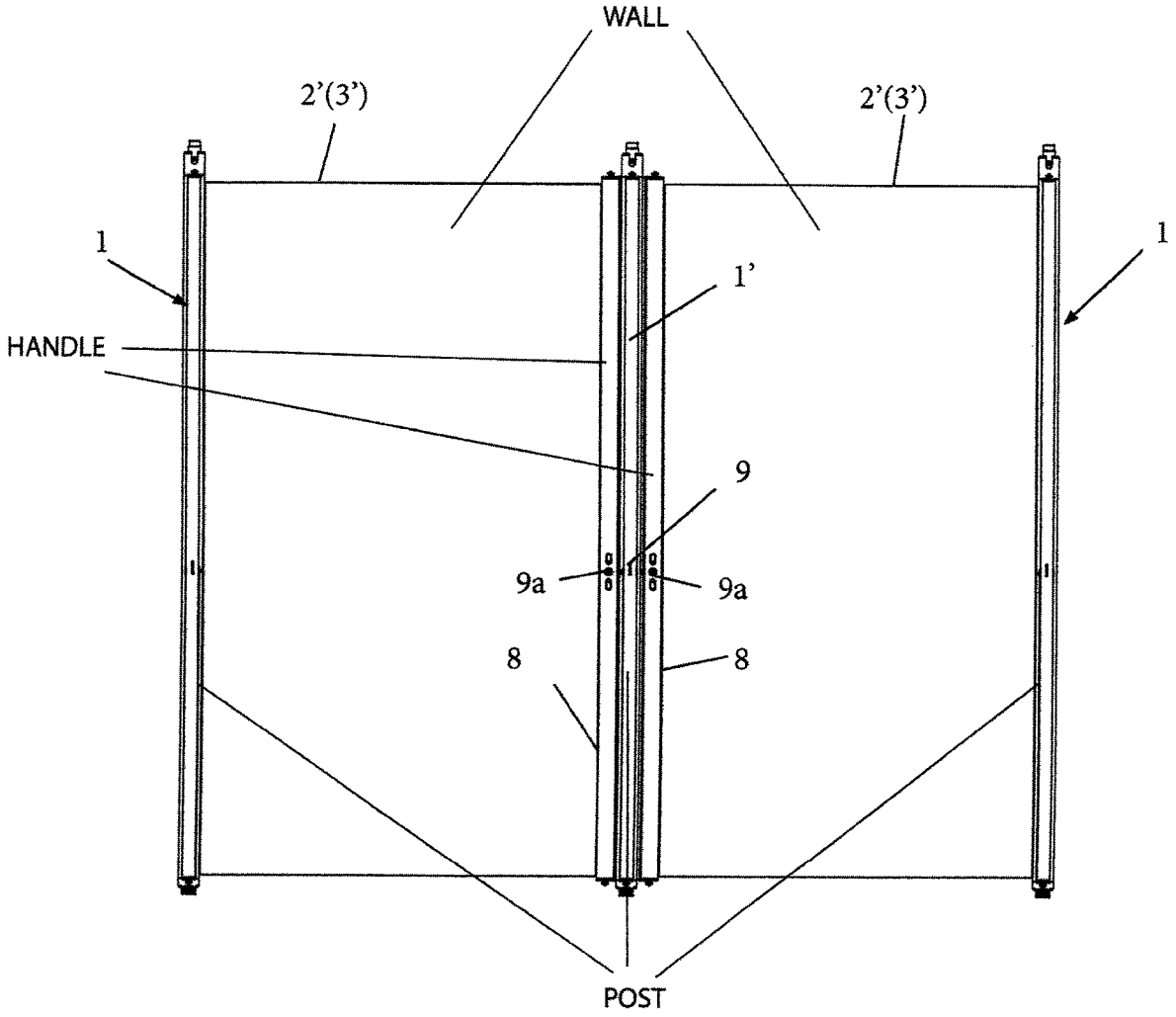
Figure 14A:
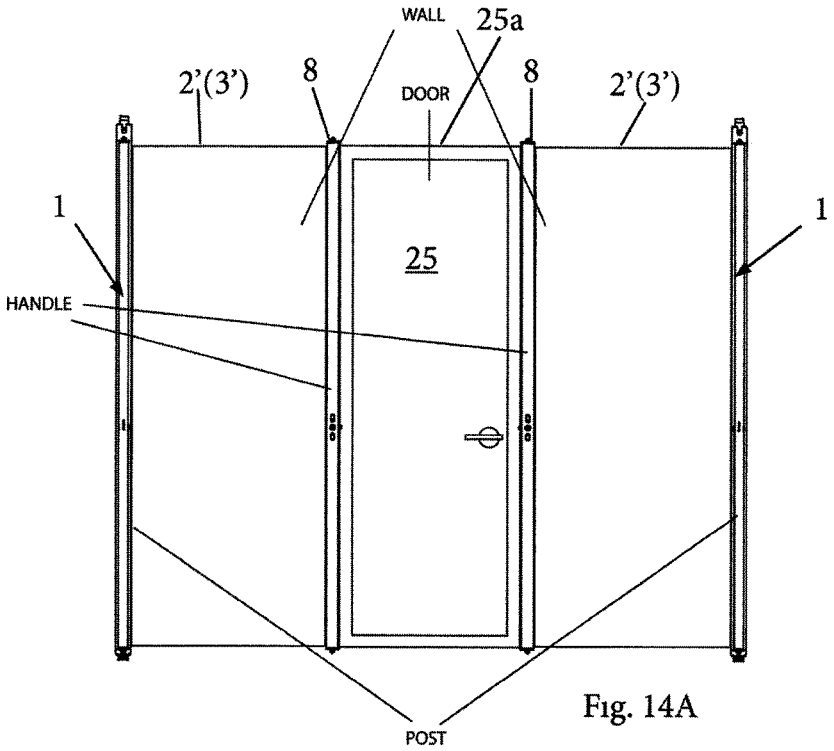
Figure 14B:
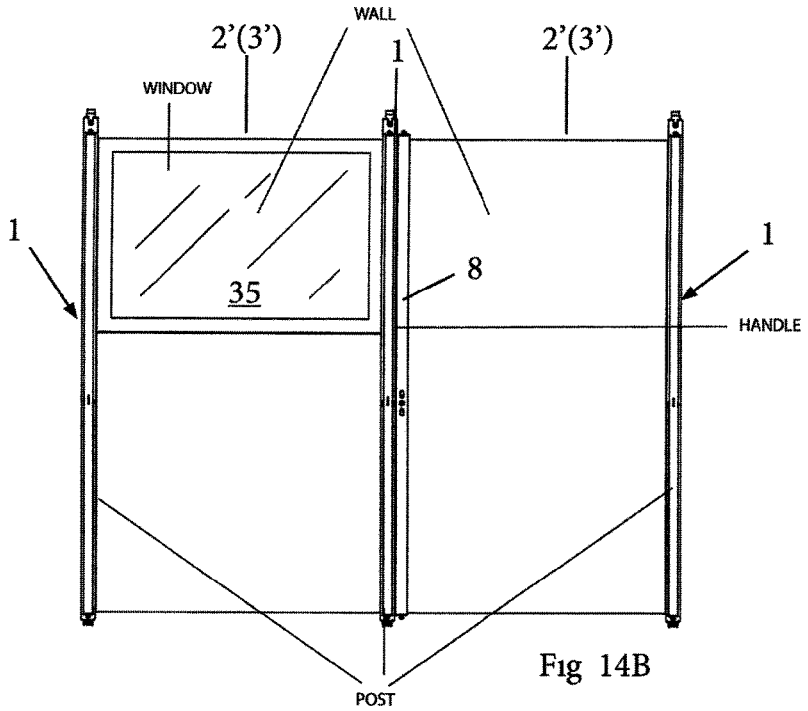
Figure 16A:
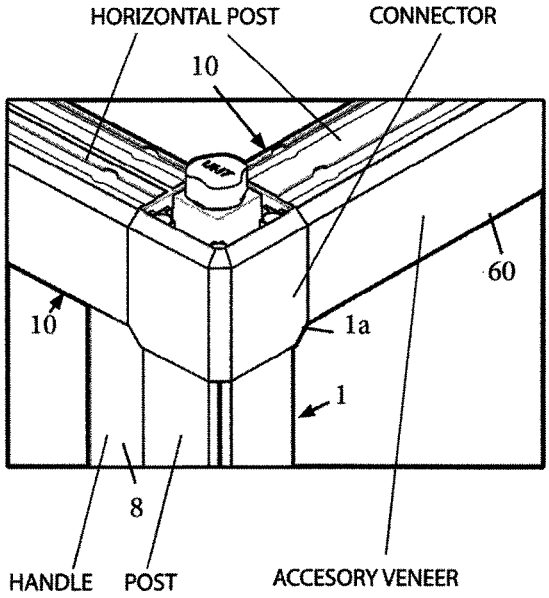
Figure 16B:
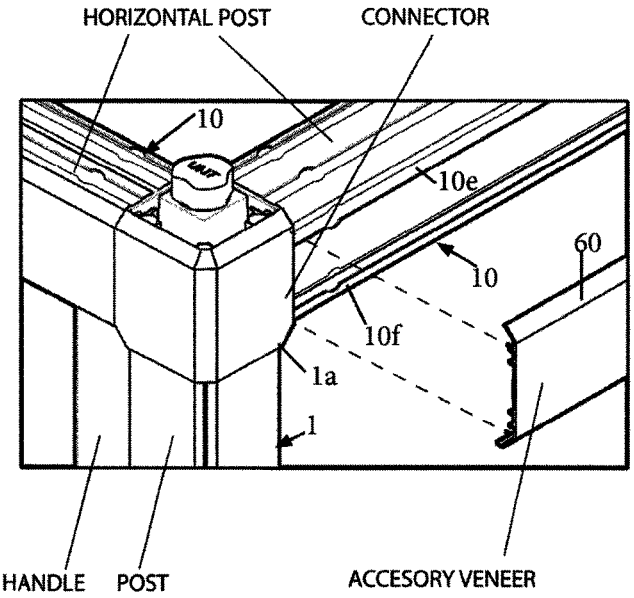
Figure 16C:
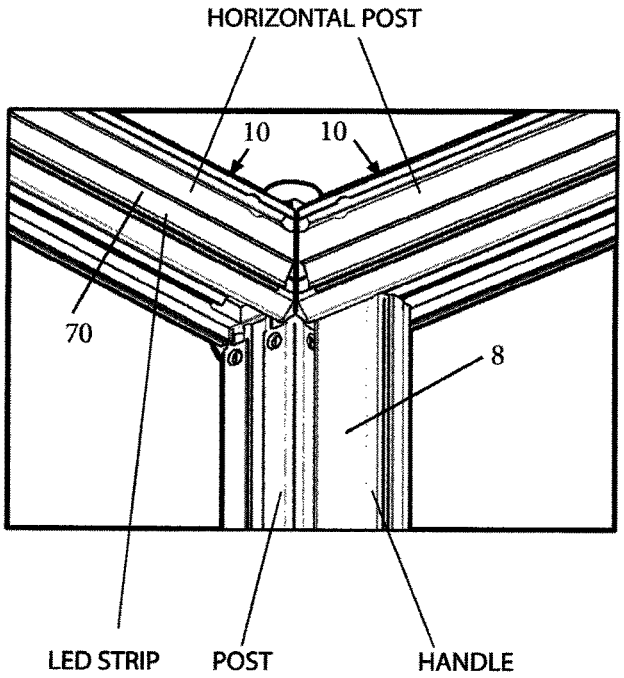
Figure 17A:
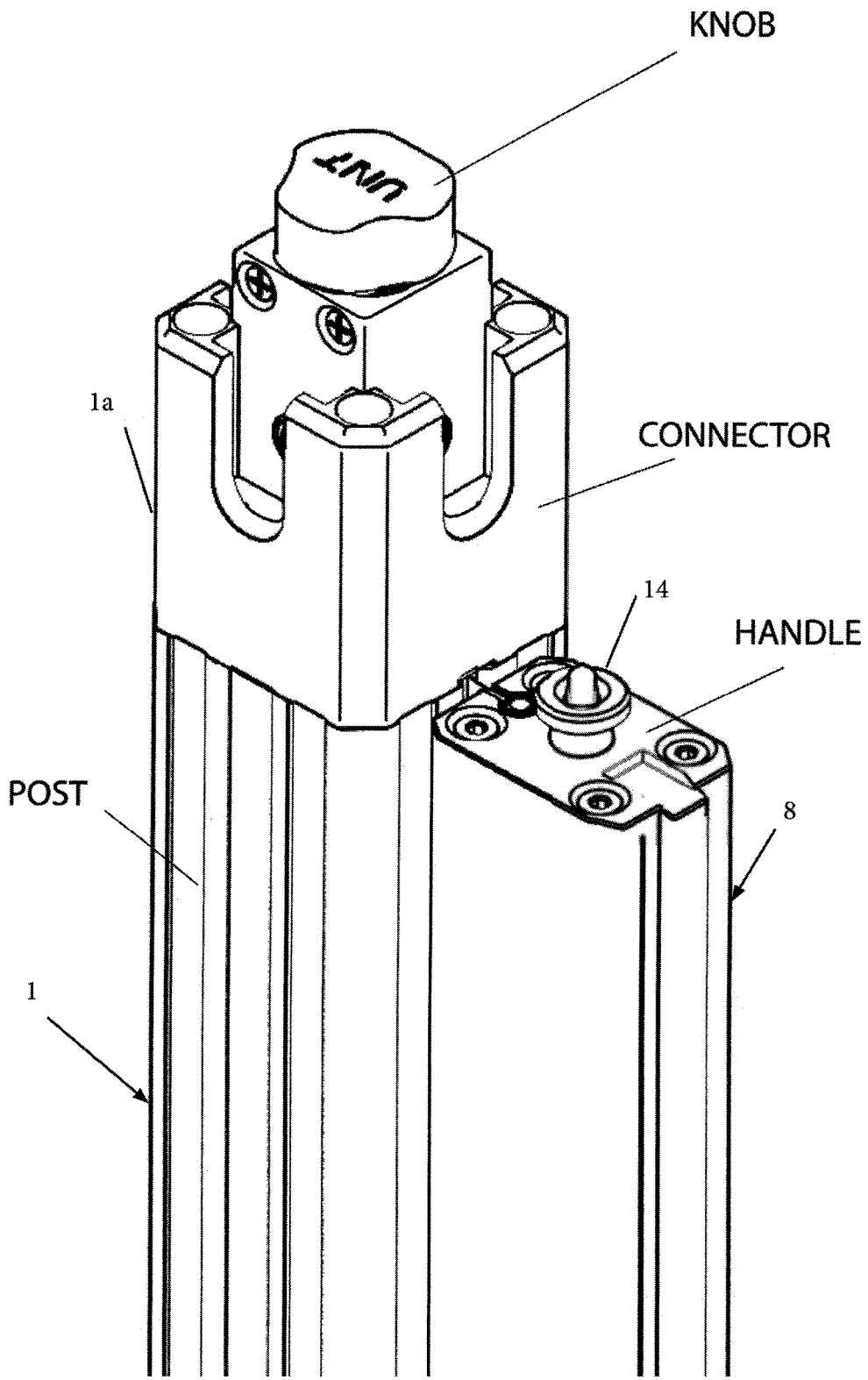

FIGS. 12A-C show various roof attachments;

FIG. 13 depicts two upright posts with contained wall coils which are extended and connected to a central upright post configured to receive and connect to handle rails for extended wall lengths;

FIGS. 14A and 14B depict examples of door and window placement between upright posts;

FIGS. 15A-D schematically depict modular structures of 1, 2, 3 and 4 cubicles with vertical lines representing upright posts and horizontal lines representing horizontal or cross beam posts;

FIGS. 16A-C are representative of external channels in the posts (upright and horizontal) used as supports for decorative veneers, lighting and the like; and FIGS. 17A and B depict the replacement and interchange of wall materials in selected upright posts (or horizontal posts, if so configured).

As a non-limiting example, in a typical simple four-sided modular structure, structural components to be utilized are four sheet-end receiving and extending elongated upright posts with a coiled flexible and durable sheet material retained on a spool retaining member contained therein. Four rod-like cross beam extension posts connect the upper ends of the elongated upright posts, and four rod-like cross beam extension posts connect the bases of the elongated upright posts. Sheet materials are extended out of openings in the elongated posts with the lateral edges of the sheet materials being engaged with the tracks of the extension posts. The sheet materials are drawn across the open area between laterally distanced elongated posts and appropriately fastened to either other sheet material ends at end connection elements or to connection elements of adjacent elongated posts, to complete the walled structure (a roof is optional). Entrance doors and/or windows are separate elements positioned with connection elements between sheet material ends or between a sheet material end and an elongated post.

DETAILED DESCRIPTION AND DESCRIPTION OF THE DRAWINGS

Figure 1A:
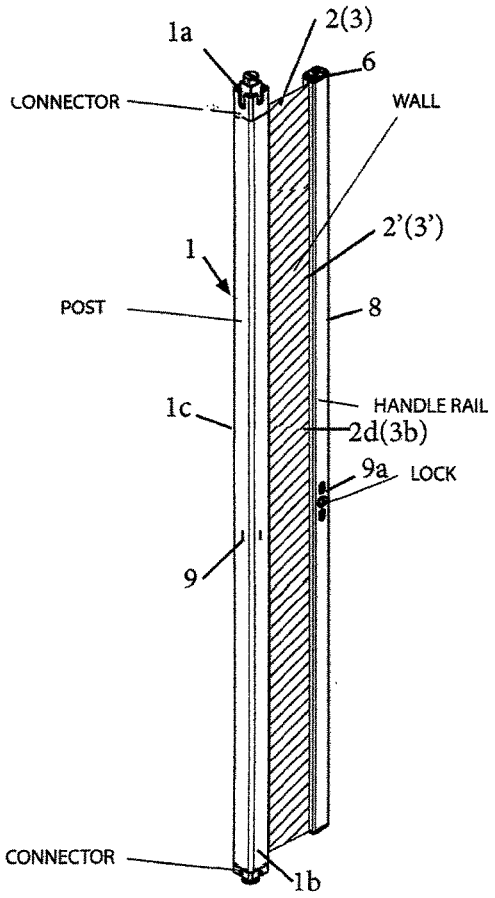
FIGS. 1A and 1B depict upright posts, each with contained rolled up wall material and handle rail (or rail handle) with wail extension to the right (FIG. 1A) and to the left (FIG. 1B) with an integral handle rail connection structure.
Figure 1B:
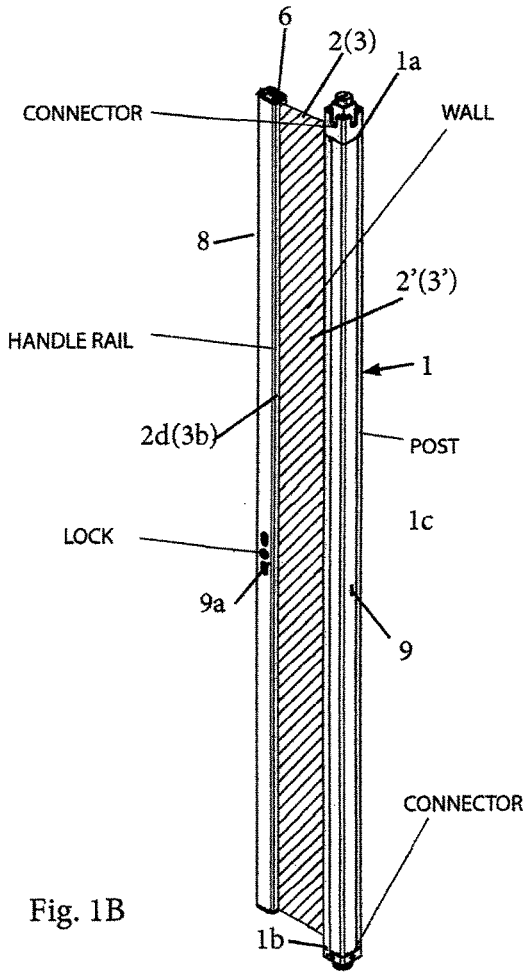
Figure 2A:
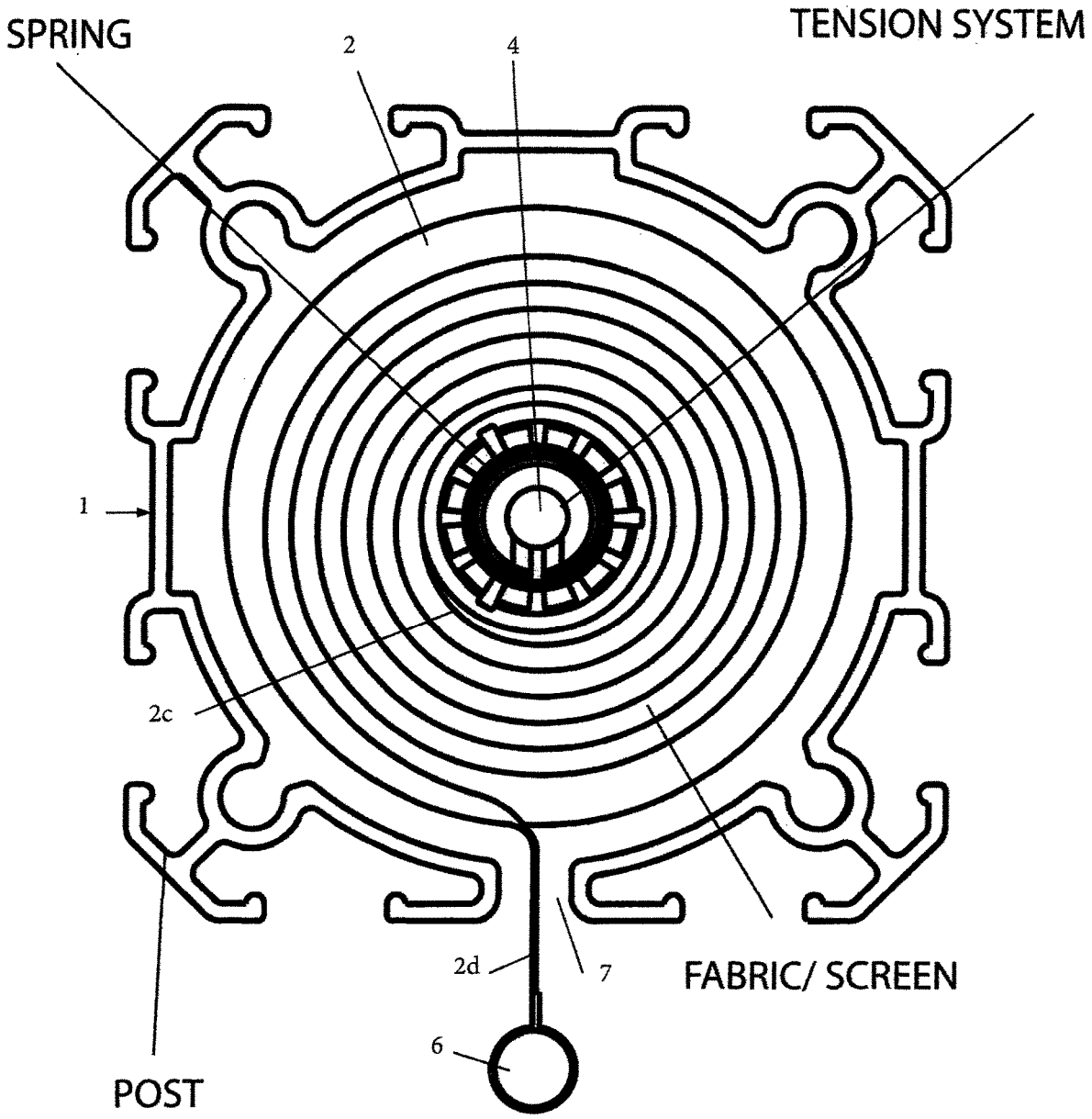
FIG. 2A is a schematic cross section view of an upright post with contained coiled wall material and slot for extension and retraction therethrough.
Figure 2B:
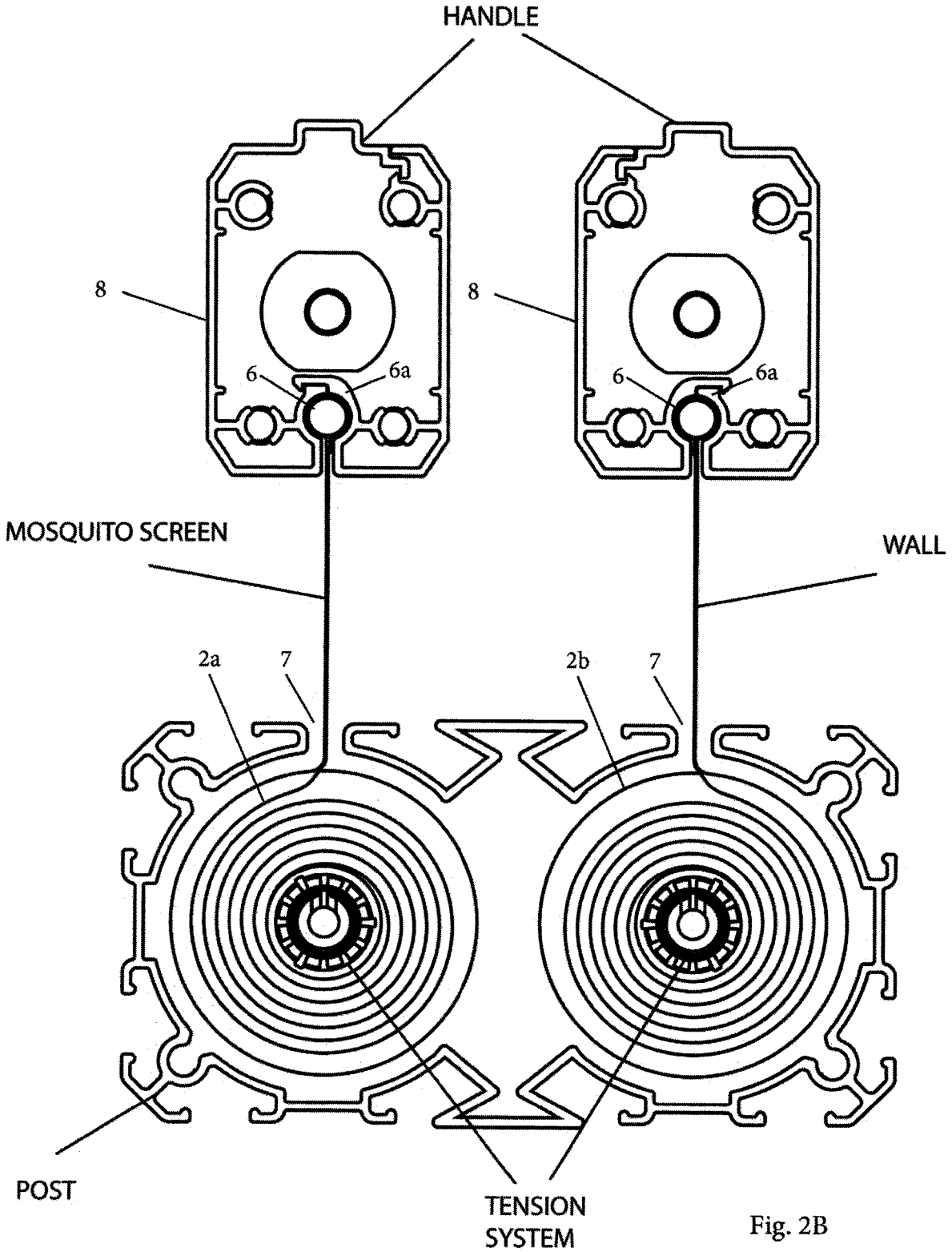
FIG. 2B is a schematic cross section view of an upright post with contained separated dual wall coils of wall and screen which can alternatively be extended outwardly.
Figure 2C:
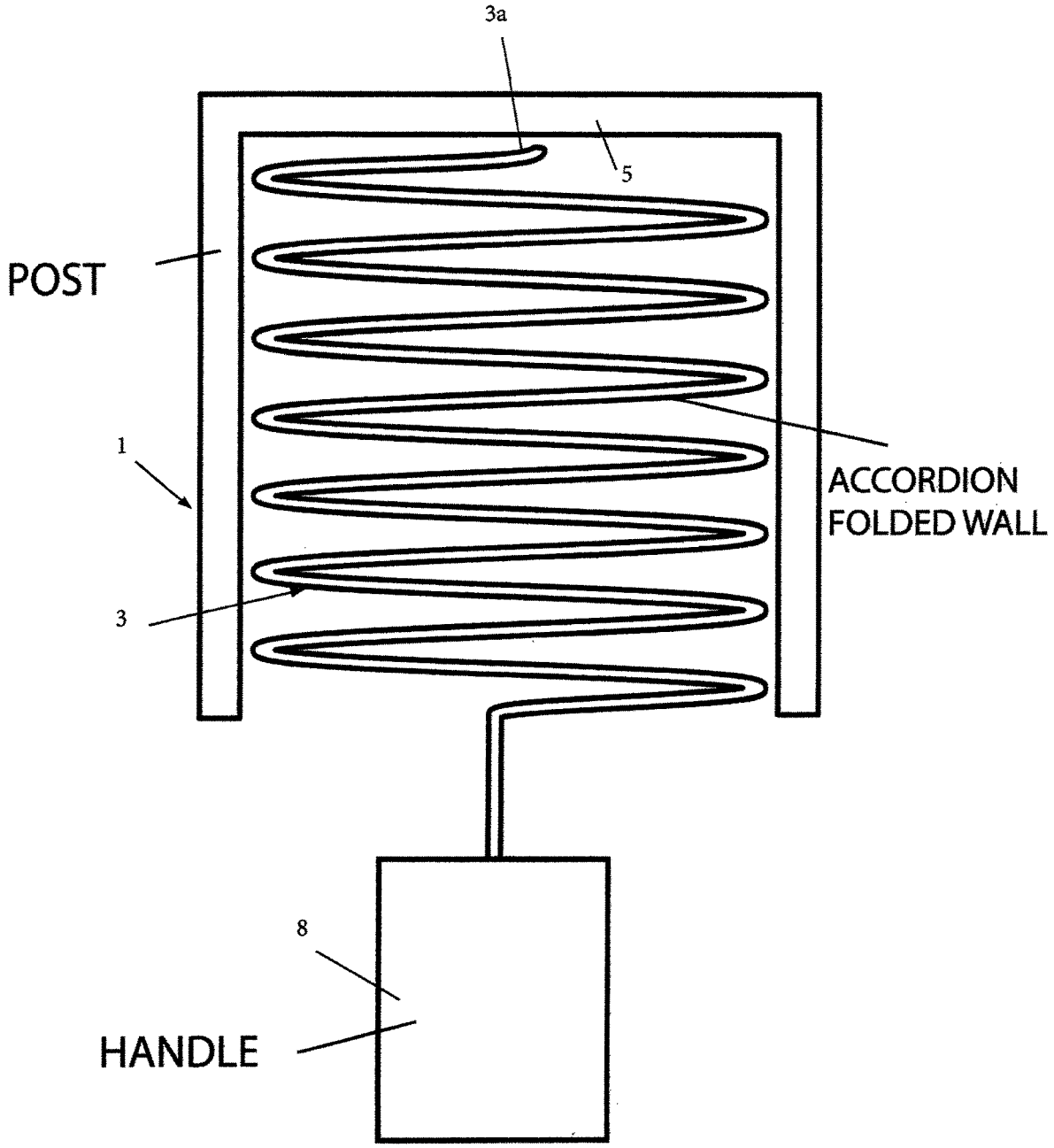
FIG. 2C is a schematic cross section depiction of an upright post with a contained accordion fold wall material.

FIGS. 1A and 1B show the basic building block of the modular structure of the invention comprising upright posts 1 having an upper end 1*a* and a lower end 1*b*. In addition, the upright posts 1 have a contained coil of a fabric or similar coilable sheet material 2 (hereinafter referred to as "fabric") as schematically shown in cross section FIG. 2A. Alternatively, the upright posts contain a foldable and stackable (accordion-like) material 3 as shown in FIG. 2C or with multiple coils such as coils 2*a* and 2*b* shown in FIG. 2B. In all the embodiments shown in FIGS. 2A-C, one end of the coiled or folded material (2*c* or 3*a*) is anchored within the upright post (to a tension rod 4 in FIGS. 2A and 2B and to a wall base 5 in FIG. 2C). The second end (2*d* and 3*b*) of the coiled and folded material terminates in an expanded element 6 (shown as a circular rod in the Figures) with the ends 2*d* and 3*b*, extending out of the upright post longitudinal slots 7 (not shown in FIG. 2C) and the expanded element 6 being engaged with co-fitting tube-like structure 6*a* in a handle rail 8 (more clearly seen in FIG. 5).

The handle rail 8 is grasped to extend the coiled fabric 2 or stacked fabric 3 away from the upright posts 1 to form walls 2' or 3' of a desired length up to the length of contained fabric material (FIGS. 13 and 14A and 14B show extending wall lengths with multiple upright posts). Tension rods 4 shown with the coiled material structures and spring-loaded foldable materials (not shown) effect retraction of the wall materials with the handle rails 8, when the modular structure is collapsed, such as for transport.

As shown, the handle rails 8 include a lock engagement structure 9, configured to be lockingly engaged with an engagement structure 9*a* in another upright post 1 (it is understood that the locking structure elements of the handle rail 8 and upright post 1 may be reversed).

Figure 3A:
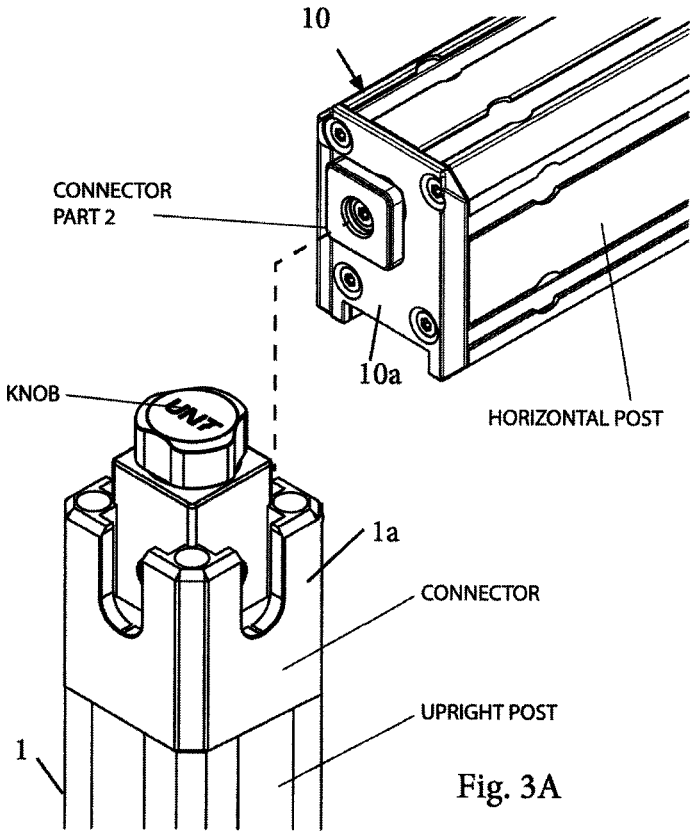
FIG. 3A is an upper end view of the upright post of either FIG. 1A or FIG. 1B showing an engagement connection thereof with an upper horizontal post or cross-connector post.
Figure 3B:
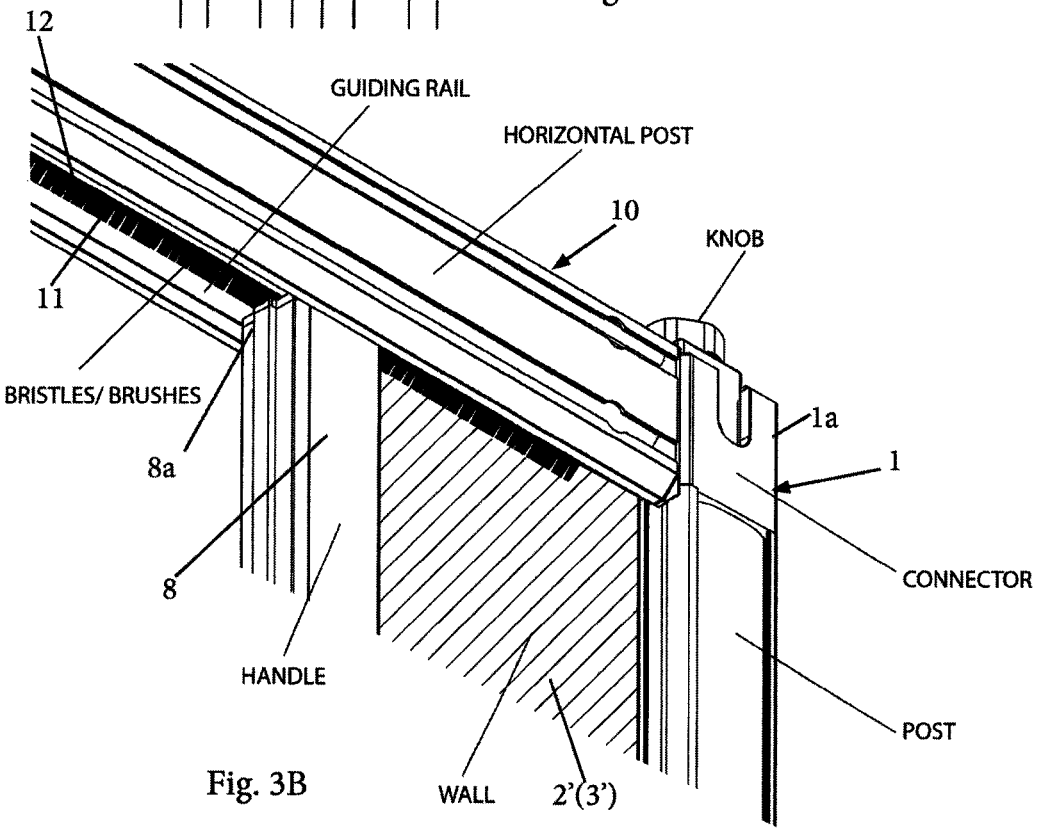
FIG. 3B is a view of the engagement of the upright post of FIG. 3A and the upper horizontal post with the wall handle and wall being drawn into guided extension in a rail track of the upper horizontal post.

The upper ends 1*a* of the upright posts 1 are configured to he integrally interlocked with co-fitting ends 10*a* of horizontal posts 10 (optionally with length variability structures such as of a telescoping nature) as shown in FIG. 3A. FIG. 3B depicts the fully seated horizontal post 10 on upright post 1, with the handle rail 8 end 8*a* being inserted into guiding rail or track 11. The fabric material (2 or 3) is drawn with the handle 8 along track 11. Brush elements 12 engage inner and outer upper peripheral surfaces of the fabric material to effectively screen any open area between the material and the track to thereby filter out insects, dust and the like.

Figure 4A:
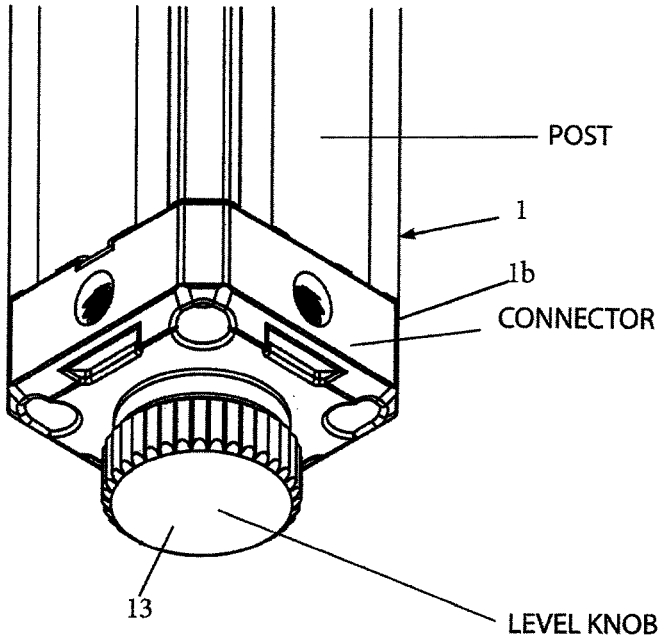
FIGS. 4A and 4B show the lower end base of an upright post and the deployment of a screw threaded levelling knob, for levelling adjustment and post alignment on uneven supporting substrates.
Figure 4B:
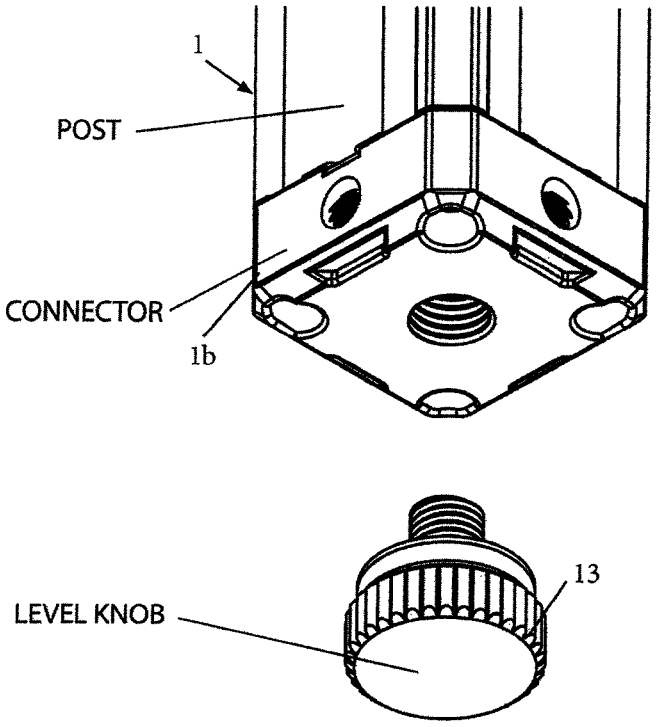

The bottom 1*b* of each upright post 1 is optionally provided with a screw-threaded levelling knob 13, as shown in FIGS. 4A and 4B, which permits separate individual height adjustment of the upright posts 1 for extending wall alignment, to compensate for irregular surfaces of substrates on which the upright posts 1 are positioned.

Figure 5:
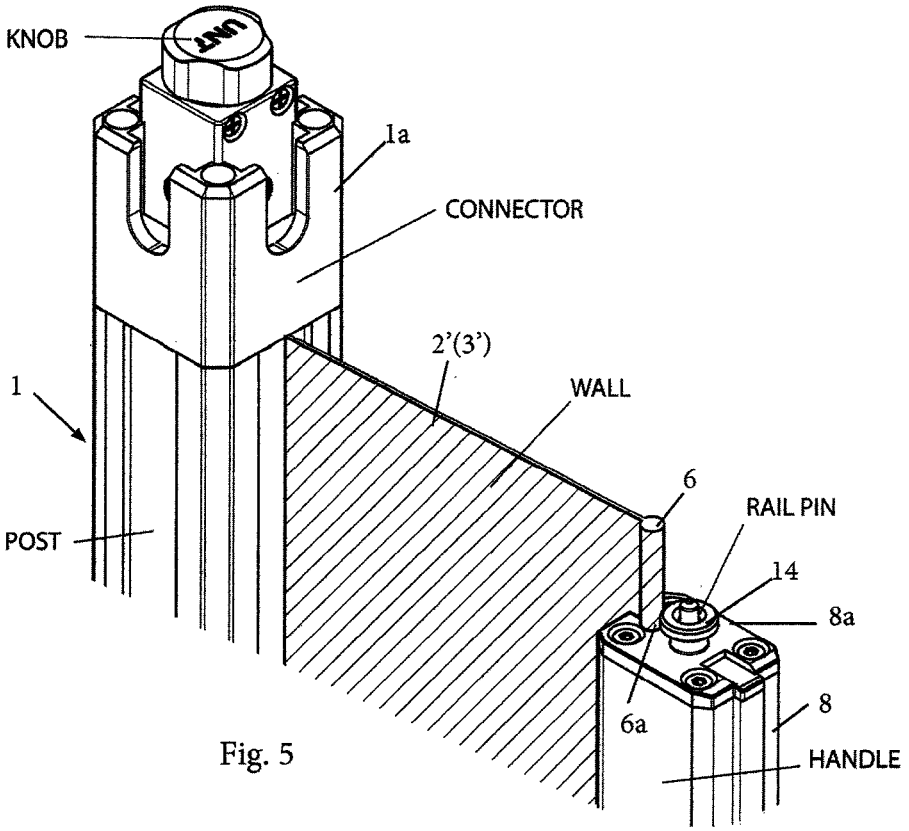
FIG. 5 is a view of an upper end of an upright post depicting connection of a wall coil end to a rail handle.
Figure 10:
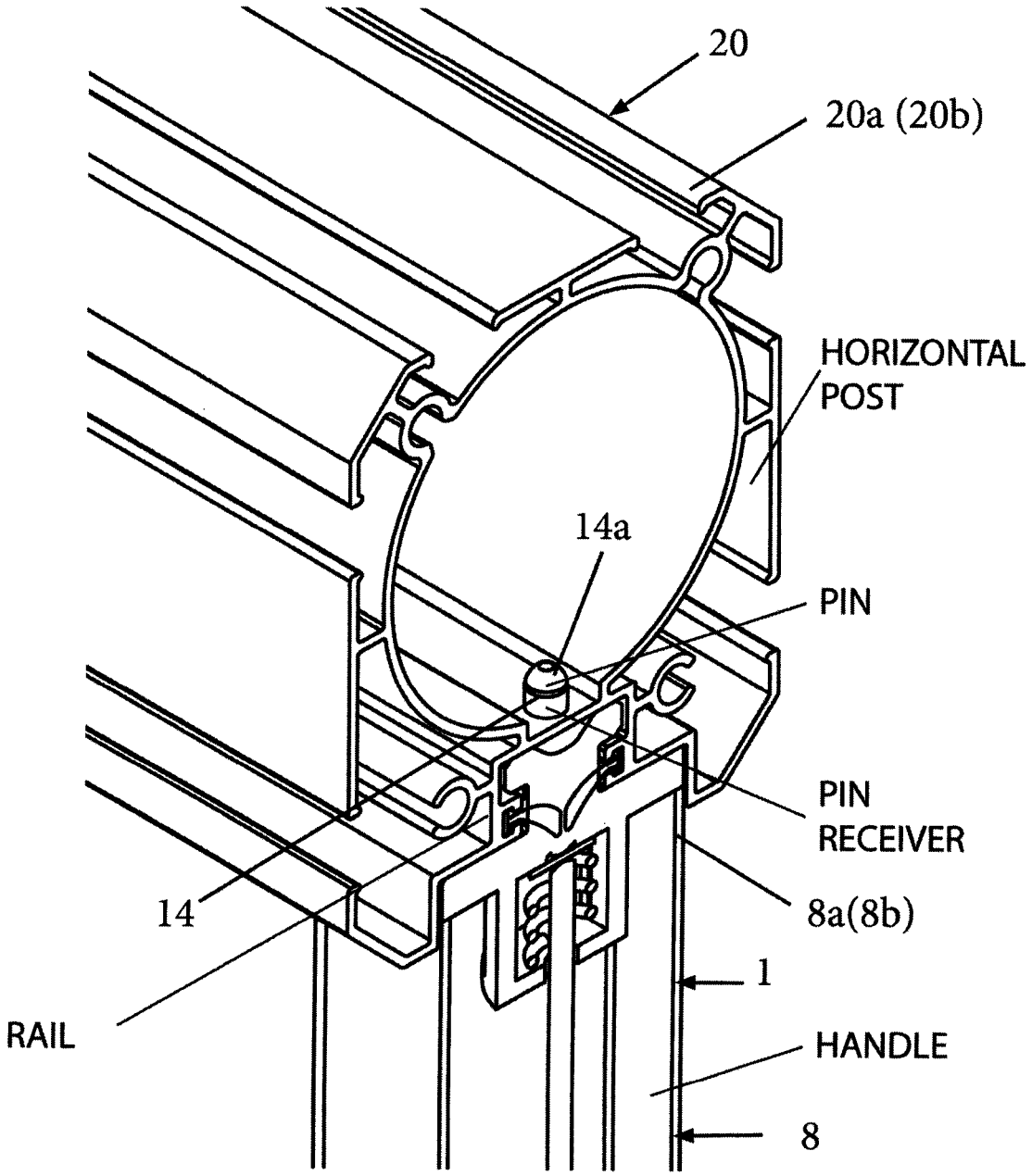
FIG. 10 is a cross sectioned view of an upper horizontal post relative to the handle rail showing a pin stop mechanism.

FIG. 5 shows a partially extended fabric wall section (2' or 3') drawn out of longitudinal slot 7 of upright post 1. Expanded wall end-element 6 is shown as extending above the handle rail 8, for clarity in viewing, but is generally either flush with the upper end 8*a* of handle rail 8 or slightly below the upper end 8*a* in a configuration as in FIG. 3B, with both the upper end 8*a* of handle rail 8 and upper edge of fabric wall 2' or 3' fitting within track 11. The top of upper end 8*a* of handle rail 8 is provided with a spring-loaded rail pin 14, which, as shown in FIG. 10, is engageable with pin receiver 14*a* in the base of track 11, to provide a positive position stop for the wall extension placement. Multiple pin receivers 14*a* are longitudinally positioned at pre-determined intervals of track 11 to permit selective wall length placement and position locking.

Figure 6:
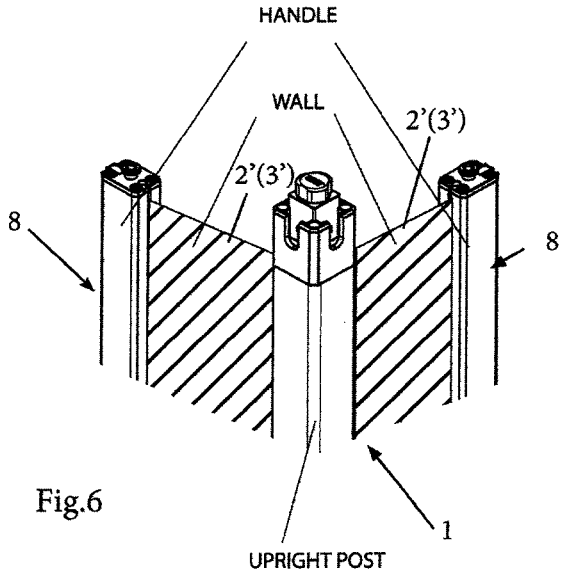
FIG. 6 illustrates right angled dual wall extensions from a single upright post.

FIG. 6 shows an upright post 1 having two contained material coils with extending walls 2' or 3' extending from slots positioned at right angles in the upright post 1. FIG. 2B shows walls drawn from dual coils 2*a* and 2*b* within uptight post 1, in alternate parallel directions.

Figure 7A:
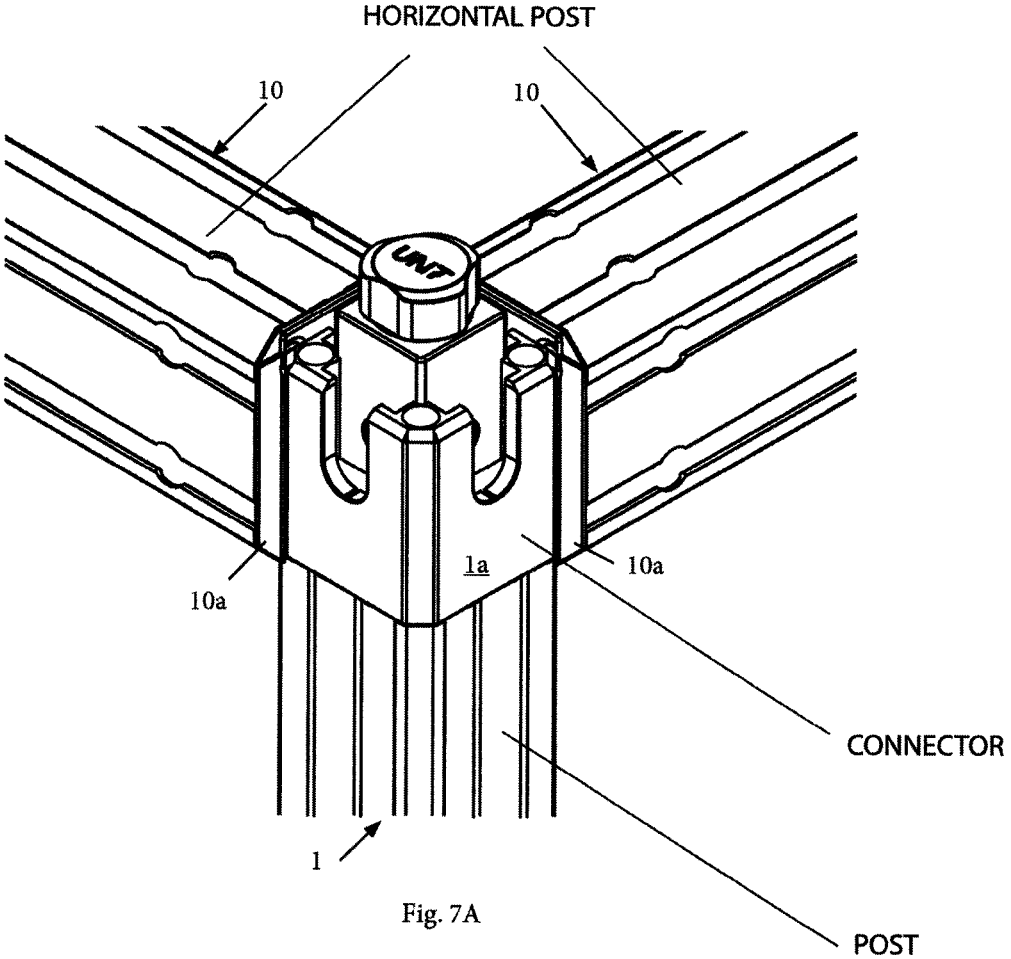
FIGS. 7A and 7B are upper and lower views of a corner upright post interlocked with right angled upper and lower horizontal posts.
Figure 7B:
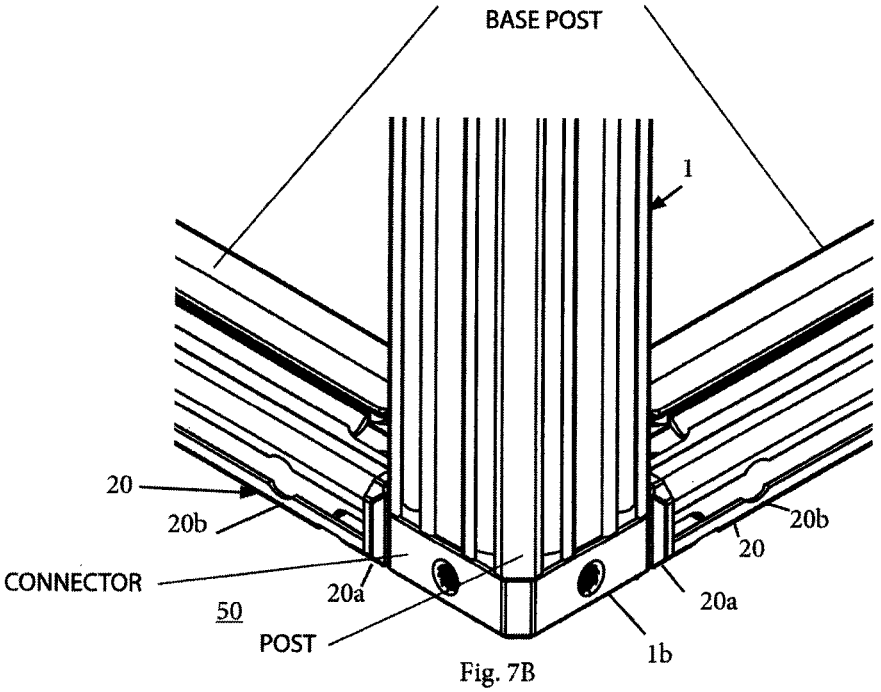
Figure 11:
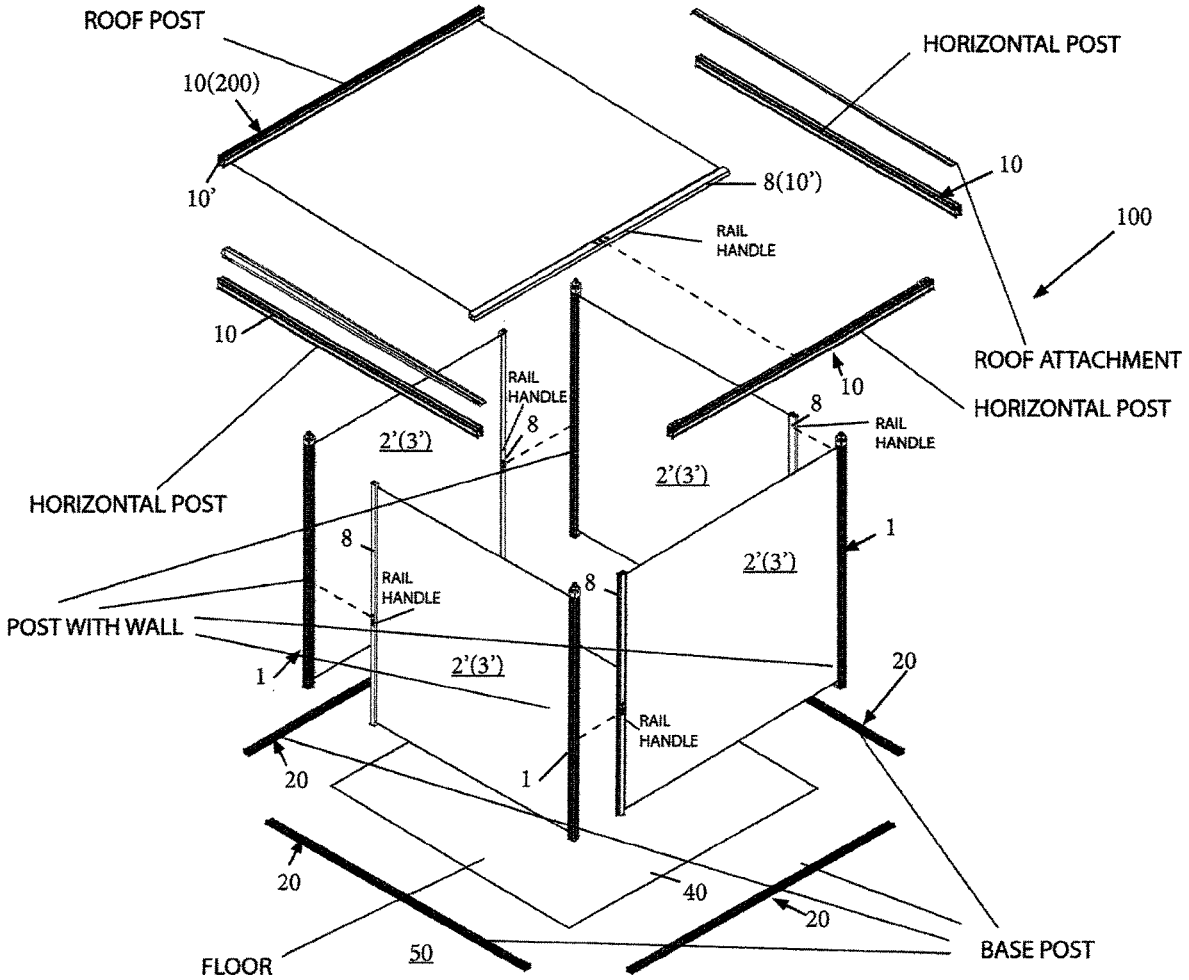
FIG. 11 is a blow-up view of components of a typical room structure using the upright wall containing posts with wall extensions, horizontal upper and lower posts, and roof and floor attachments.

FIGS. 7A and 7B show the upper end 1*a* of an upright post 1 being connected to the ends 10*a* of two upper horizontal posts 10 in a right-angle corner arrangement (FIG. 7A) and the lower end 1*b* of the upright post 10 being connected in a right-angle corner arrangement (FIG. 7B) with the ends 20*a* of two lower horizontal posts 20, with a bolt connection. The lower end 1*b* of the upright post 1 and the bottom surface 20*b* of the horizontal posts 20 are generally flush with a supporting ground or substrate surface 50 unless the lower end 1*b* of upright post 1 is provided with the level knobs 13, as shown in FIGS. 4A and 4B, which results in about a half inch elevation, which can be filled in with a base floor element 40 such as shown in FIG. 11.

Figure 8A:
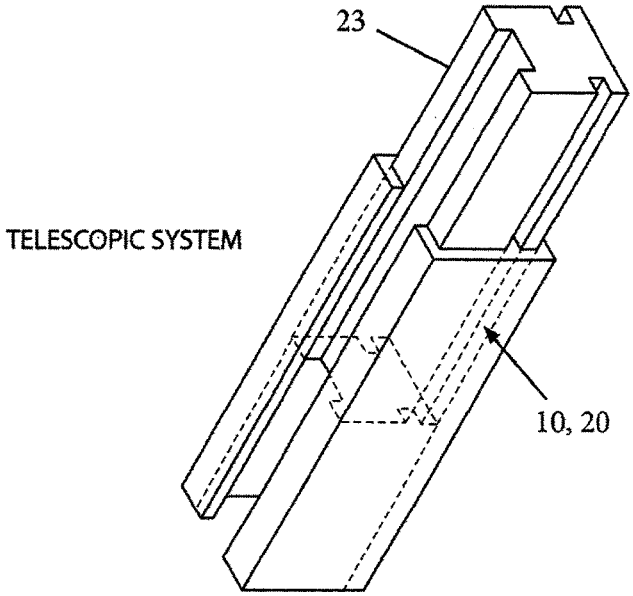
FIG. 8A is a section of an upper or lower horizontal post showing telescopic length extension for wall length adjustment.
Figure 8B:
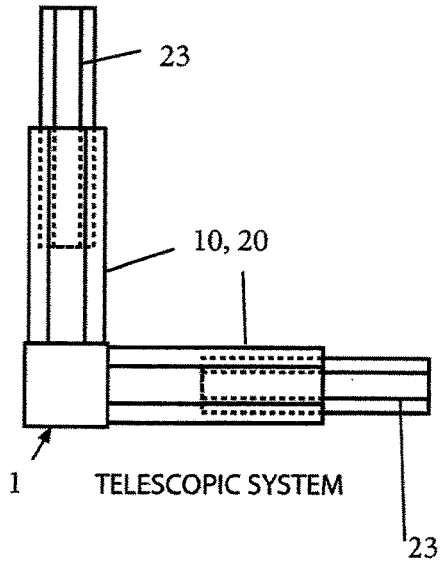
FIG. 8B show a right angled connected section of the horizontal post showing the telescopic length extension.

FIGS. 8A and 8B show an optional extendable telescopic section 23 in conjunction with the horizontal upper or lower post elements 10, 20 to provide adjustable wall lengths. FIG. 8A shows a single horizontal post element unit (10 or 20) with extension element 23 and FIG. 8B shows two horizontal post elements (10 or 20) as arranged in a right-angled connection with upright post 1.

Figure 9:
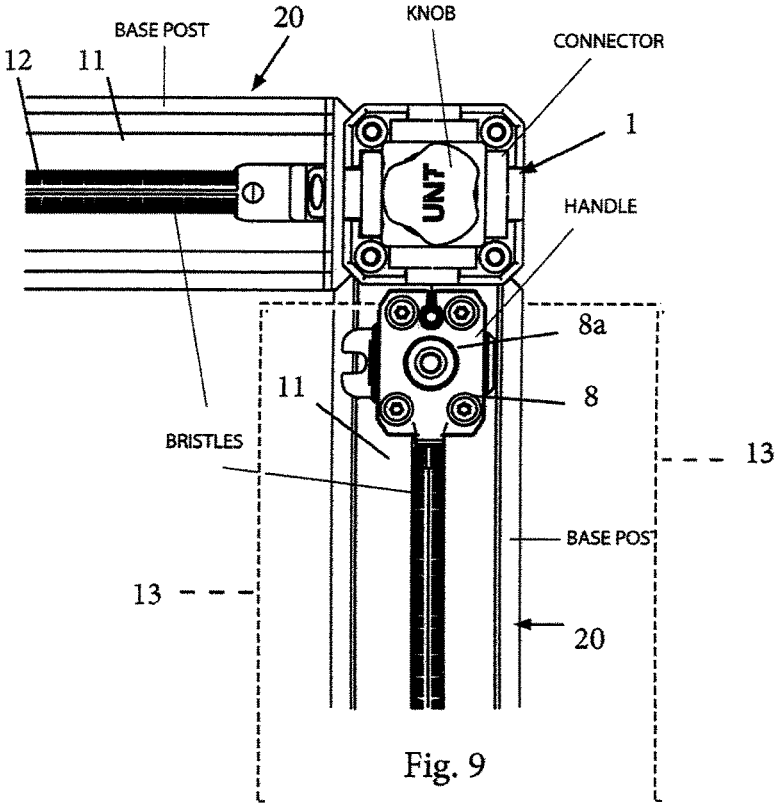
FIG. 9 is a top view of an upright post, without visible upper horizontal post deployment, showing right angled positioned horizontal base posts.

FIG. 9 is a top view of the top of upper end 1*a* of upright post 1, with a right-angled connection to two horizontal base posts 20. The top 8*a* of rail handle 8 is shown as extending upwardly from horizontal base post 20. The rail handle 8 is in the adjacent position relative to the upright post 1 with upwardly visibly exposed tracks 11 and brush elements 12, through which the lower rail handle end 8*b* with fabric wall 2 or 3 is drawn. Ramp elements 13 as part of lower post 20 are shown in dotted lines.

As described above, FIG. 10 provides a cross section view of the upper end 8*a* of handle rail 8 and horizontal post 20 (upper (20*a*), as shown, but optionally similar for lower (20*b*) horizontal post and handle rail lower end 8*b*). The pin 14 and receptacle engagement for wall position retention or locking (similar to those used for telescoping elements such as canes), is shown.

FIG. 11 is an exploded view of a four-sided room 100 constructed with the above-described modular components. Four identical upright posts 10, each having a coiled fabric wall material 2 contained therein are shown with the fabric being outwardly drawn through slots in the upright posts 10 and attached to successive posts 10 to form the fabric walls 2' or 3'. Four upper and four lower horizontal posts 10 and 20 provide cross connection between the upright posts 1 and gliding tracks for the extended walls 2' (3') and handle rails 8. Roof attachments 10' provide tracks for roof extension element 210 extending out from roof post 200 (having a coiled fabric or other material contained therein similar to that of the upright posts). An optional floor 40 is similarly configured (not shown) and can serve to fill in gaps between the lower horizontal post and the supporting floor or surface 50.

With the component dimensions of FIG. 11 being about 3 inches by 3 inches (with a 2.5" inch core) by about a seven foot height, a compacted profile of the components for the construction of a 10'×10'×7' module room is significantly less that a square foot by seven feet in length (and a weight of about 150 pounds or less) making it ideal for transport and multiple site erection. In fact, the module is ideal for use on movable platforms such as truck flatbeds, with the walls being appropriately sized. Alternatively, the upright posts may be imbedded in ground surfaces (where appropriate) with structural elimination of lower horizontal posts, with the ground providing such function.

FIGS. 12A-C show various attached, resting or draped roof members for the room structure of FIG. 11, with, for example, slanted roof 300 of FIG. 12A with an advantage or permitting sloughing off of rain or snow, if used outdoors. Louvered roof structure 301 is shown in FIGS. 12B in closed configurations. FIG. 12C shows a bamboo covered resting (unattached) roof 302, such as used for a sukkah structure.

Because of the finite length of wall material possible in upright posts with consideration of ease in handling and transport weight wall length is increasable, as shown in FIG. 13, wherein extended walls 2' (3') are attached such as with an upright post 1' having dual fastening elements. If the handle rails 8 are properly configured with hermaphroditic connections they can be directly connected without an intermediate connection post.

FIGS. 14A and 14B are illustrative of various door 25 and window 35 components respectively which can be positioned between handle rail elements 8 at any desired position (using pin placement wall positioning as described above). Track element 11, not shown, in the horizontal posts, provide structural support for the doors and windows particularly if provided within separate frames 25*a* and 35*a*. As described above, if base cross beams are utilized it is advantageous to provide ramped structures to such base cross beams in at least the areas leading to the doors.

Figure 15A:
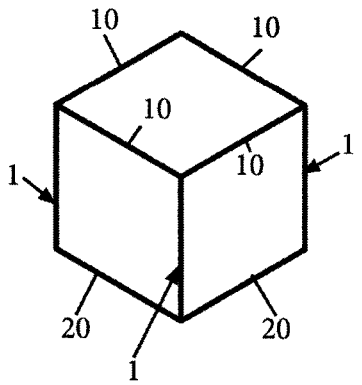
Figure 15B:
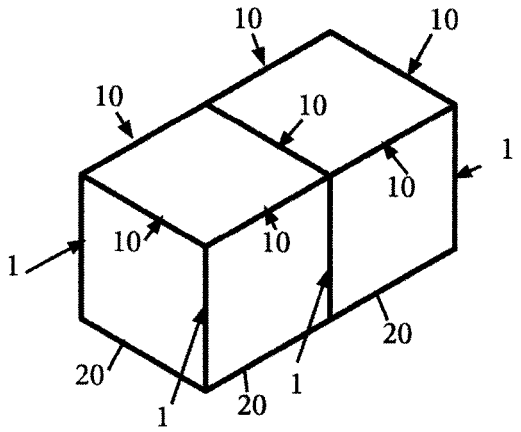
Figure 15C:
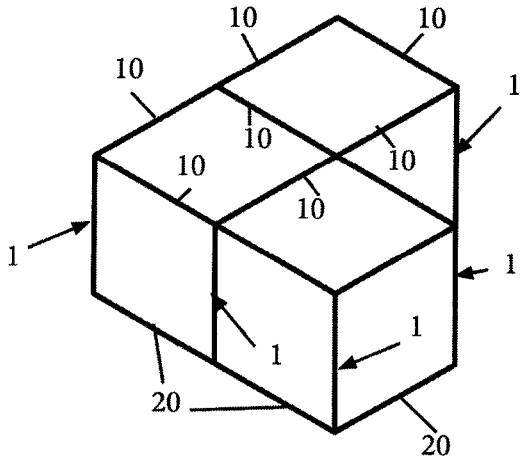
Figure 15D:
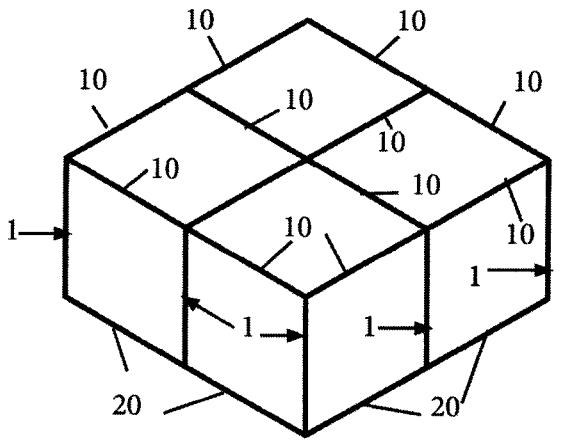

Though FIG. 11 and schematic FIG. 15A depict a single room module, it is possible to provide multiple room modules such as the 2, 3 and 4 rooms modules of schematic FIGS. 15B-D (with additional rooms being further possible). The straight lines in schematic FIGS. 15A-D represent various post and handle rail elements. In such embodiments, the upright posts 1 are selected to provide appropriate wall extensions (including dual wall call containment) and handle rail connections. In addition, the upright post ends are configured to accept horizontal post connections from four sides, as shown in FIGS. 7A and 7B, which permits multiple continuous connections for additional cubicle modules. Modules of varying sizes may be made and conjoined by judicious arrangement of the upright posts and horizontal cross beams (and roofing on a customizable or separately supported basis).

The posts, whether upright or horizontal are provided with external channels and internal through hollows to permit the placement of decorative covers such as moldings and veneers and the drawing therethrough of various structure enhancements, such as lighting, heating, plumbing, cooling, electrical and data wiring and the like. FIGS. 16A-C are illustrative of accessory veneer 60 placement in channels 10*e* and 10*f* of horizontal post 10 (FIGS. 16A and 16B). Lighting, in the form of LED strips 70 are shown as being positioned in horizontal post 10 of FIG. 16G.

Figure 17B:
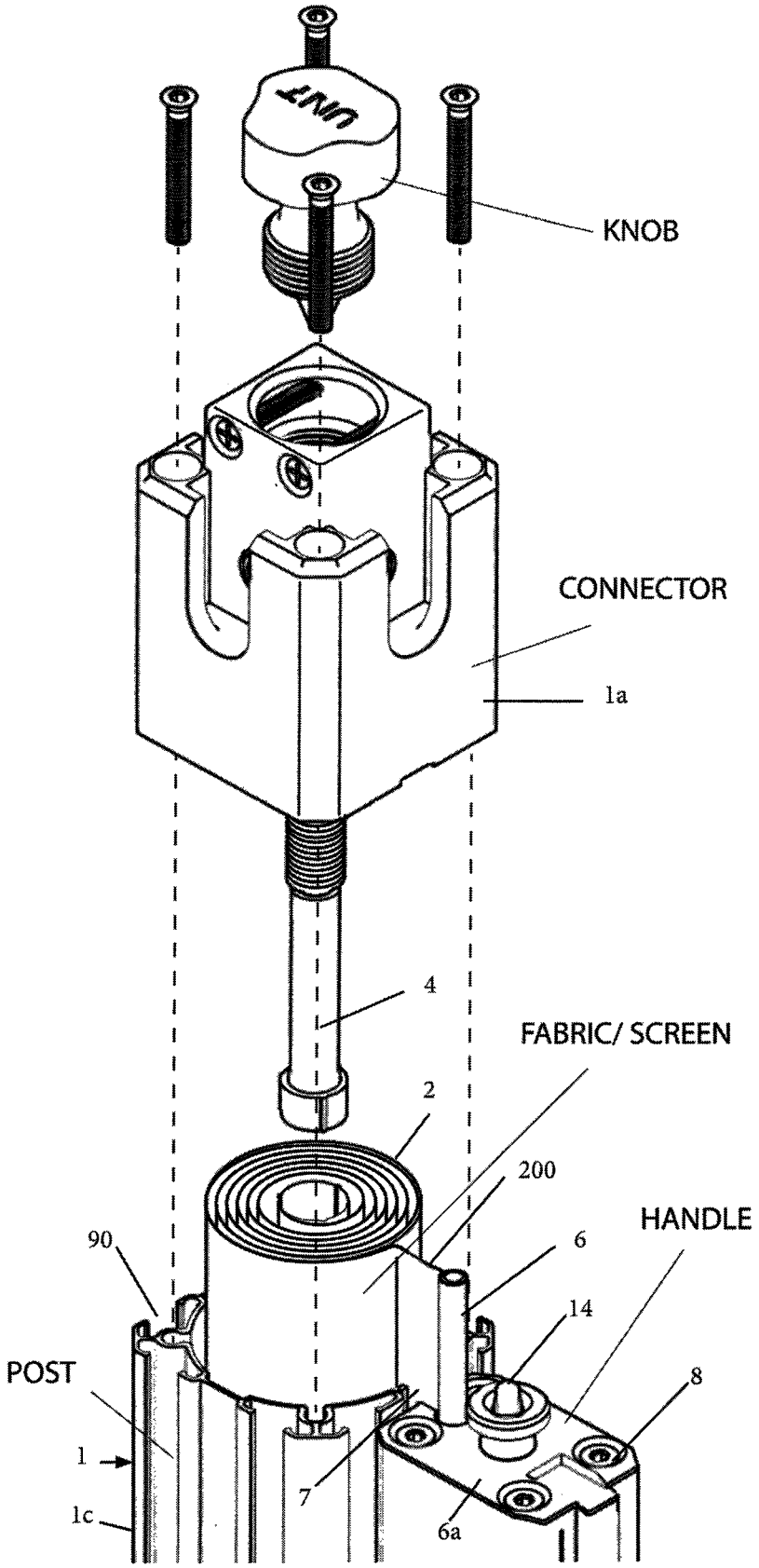

FIGS. 17A and B depict the removal and replacement of wall coils in an upright post. FIG. 17A shows post 1 as closed, with rail handle 8 attached to a coil of fabric therein. In exploded view of FIG. 17*b*, the end 1*a* of post 1 is detached from body 1*c* with spool tension rod 4 lifted from fabric coil 2. Fabric coil 2 is then removed from hollow 90 in post 1. Extended segment 200 and expanded wall end element 6 is lifted from slot 7 and rail handle 8 respectively. The coil 2 is removed and replaced by another coil with expanded element 6. Expand element 6 is fitted into rail handle 8, extended segment 200 (of new coil 2) is fitted into slot 7 and new coil 2 is fitted into the hollow of post body 1*c*. End 1*a* is re-attached to post 1 and a new wall is available for construction of a module. New coils may have different decorative appearance or may be of different materials to provide interchangeable features, appearance and the like for the module formed therewith.

It is understood that the above description, drawings and examples are merely illustrative of the invention and that various structural components, permutations and combinations and the like are possible without departing from the scope of the invention as defined by the following claims.

What is claimed is:

1. A modular enclosure structure having:

at least three walls and comprised of at least three elongated posts selected from:

a) at least two elongated vertical or horizontal posts, with each having at least one longitudinal hollow therein with each hollow having a flexible and durable compacted sheet material therein and wherein each post further comprises a narrow longitudinal through-slot aligned with a free end of each of the compacted sheet materials, whereby the sheet material in each hollow is configured to be externally drawn and retracted with manipulation of the free end, with the free end of each sheet material comprising a latching member, wherein the compacted sheet material comprises a second end attached to a tensioning element which maintains tension of the compacted sheet material and which provides retraction thereof, and b) an elongated vertical or horizontal post, comprising at least two circumferentially angularly separated latching members which cooperatively latch with the latching member of the free end;

wherein one or more of the posts having the compacted sheet material therein include the two separated latching members and wherein walls of the sheet material are externally drawn from the posts having sheet material therein and latched to each other or to posts having the two separated latching members to define an enclosure comprising said at least three walls of the sheet material, wherein the free end of the compacted sheet material is fastened along a longitudinal length thereof to a longitudinally positioned elongated rail handle, having upper and lower ends, which provides structural rigidity to the free end of the sheet material and provides an extending handle to draw and retract the sheet material and wherein the latching member of the free end is attached to the rail handle.

2. The modular structure of claim 1, wherein the posts are configured to retain at least one of decorative or utilitarian elements.

3. The modular structure of claim 1, wherein each post, having the compacted sheet material and each post having the two separated latching members, are vertical posts, each having upper and lower ends with coupling structures and wherein ends of a respective elongated horizontal post, having two ends, are coupled to upper ends of spaced apart adjacent vertical posts, thereby forming an enclosing upper perimeter.

4. The modular structure of claim 3, wherein each vertical post comprises a height adjustment member whereby the vertical post is capable of being aligned to compensate for irregularities in a surface of a supporting substrate.

5. The modular structure of claim 3, wherein the compacted sheet material is comprised of at least one coil of sheet material or accordion folded sheet material and wherein the vertical posts comprise through-slots for each of free ends of coiled or accordion folded sheet material.

6. The modular structure of claim 3, wherein an end of vertical posts having compacted sheet material is removable and replaceable whereby contained compacted sheet material is exchangeably removable.

7. The modular structure of claim 3, wherein a door or window within a support frame having fastening elements configured to engage latching members of the free ends is latchingly positioned between rail handles to provide respective a door or window for the modular structure.

8. The modular structure of claim 3, wherein the upper horizontal posts support or are engaged with a roof structure.

9. The modular structure of claim 3, wherein the posts are configured to provide modules of varying sizes or multiple connected modules wherein each vertical post comprises end engagement configurations for engagement with ends of four other posts.

10. The modular structure of claim 3, wherein the rail handle comprises an upper end comprised of a guiding-track engaging element wherein each horizontal post comprises a downwardly facing longitudinal track configured to engage the guiding-track engaging element of the upper end of the rail handle whereby the rail handle, with attached free end of the sheet material, is laterally movable to draw and retract the sheet material in a guided path to form a wall of sheet material between spaced apart adjacent vertical posts with an upper edge of the sheet material of the formed wall being laterally enclosed within or adjacent to the longitudinal track, whereby the sheet material comprises the wall in a single plane with minimal deviation from the plane.

11. The modular structure of claim 10, wherein the longitudinal track and the top of the rail handle comprise releasable engaging elements at predetermined spaced intervals, configured to stop and maintain the rail handle, with extended sheet material, in a position to provide a desired wall length.

12. The modular structure of claim 10, wherein the track contains brush material extending along a length of the track and extending across each peripheral side of the track to engage the upper edge of the sheet material.

13. The modular structure of claim 12, wherein ends of an elongated horizontal post are coupled to lower ends of spaced apart adjacent vertical posts, thereby forming an enclosing lower perimeter.

14. The modular structure of claim 13, wherein each elongated horizontal post, coupled to the lower ends of the vertical posts comprises an upwardly facing longitudinal track configured to engage a lower guiding-track engaging element end of the rail handle whereby the rail handle, with attached free end of the sheet material, is laterally movable to draw and retract the sheet material to form a wall of sheet material between spaced apart adjacent vertical posts with a lower edge of the sheet material of the formed wall being laterally enclosed within or adjacent to the upwardly facing longitudinal track.

15. The modular structure of claim 13, wherein the horizontal posts comprise telescopic elements which permit for length extension thereof.

* * * * *